United States Patent [19]

Asano et al.

[11] 4,266,374

[45] May 12, 1981

[54] GRINDING MACHINE WITH TRUING APPARATUS FOR GRINDING WHEEL MADE OF CUBIC BORON NITRIDE

[75] Inventors: Hiroaki Asano; Ikuo Suzuki, both of Chiryu; Minoru Enomoto, Ohbu, all of Japan

[73] Assignee: Toyoda-Koki Kabushiki-Kaisha, Kariya, Japan

[21] Appl. No.: 29,904

[22] Filed: Apr. 13, 1979

[30] Foreign Application Priority Data

Apr. 18, 1978 [JP] Japan ..... 53-45707

[51] Int. Cl.[3] ..... B24B 49/18

[52] U.S. Cl. ..... 51/165.87; 125/11 CD

[58] Field of Search ..... 51/165.87, 165.88; 125/11 R, 11 CD

[56] References Cited

U.S. PATENT DOCUMENTS

| | | | |
|---|---|---|---|
| 980,164 | 12/1910 | Nichols | 51/165.88 |
| 3,457,678 | 7/1969 | Temple | 125/11 R |
| 3,500,811 | 3/1970 | Perkins | 125/11 R |
| 3,590,799 | 7/1971 | Gluchowicz | 125/11 R |
| 4,073,281 | 2/1978 | Asaeda | 125/11 CD |
| 4,122,635 | 10/1978 | Asano | 51/165.71 |

*Primary Examiner*—Harold D. Whitehead

*Attorney, Agent, or Firm*—Oblon, Fisher, Spivak, McClelland & Maier

[57] ABSTRACT

A grinding machine comprising a truing apparatus for truing a grinding wheel made of cubic boron nitride. A traverse carriage of the truing apparatus is mounted for movement in a direction parallel to the axis of the grinding wheel. A truing head carrying a truing wheel is mounted on the traverse carriage for movement toward and away from the grinding surface of the grinding wheel. A detection member is mounted on the truing head to be movable toward the grinding wheel. The truing head is first fed toward the grinding wheel until the contact between the detection member and the grinding wheel is detected. The truing head is then fed toward the grinding wheel by a truing amount in response to the detection of the contact between the detection member and the grinding wheel.

6 Claims, 7 Drawing Figures

GRINDING MACHINE WITH TRUING APPARATUS FOR GRINDING WHEEL MADE OF CUBIC BORON NITRIDE

BACKGROUND OF THE INVENTION

1. Field of the Invention

The present invention relates to a grinding machine with a truing apparatus for truing a grinding wheel made of cubic boron nitride.

2. Description of the Prior Art

In a grinding machine with a grinding wheel of such configuration that abrasive grain, made of a hard material, such as cubic boron nitride, is press-formed and stiffened on the outer peripheral surface of a base ring made of aluminum, there is provided a truing apparatus for truing such grinding wheel. In such grinding machine, it is very important to accurately control the in-feed amount of the truing apparatus against the grinding wheel. However, in the past, it was very difficult to stably control the in-feed amount within the accuracy of ± several microns. The main reasons for this difficulty are that the grinding wheel is thermally expanded by the change in the atmospheric temperature, coolant temperature and bearing temperature, resulting in a change in the relative positions between the truing wheel of the trying apparatus and the grinding wheel, and that the grinding wheel is slightly worn out by the grinding operations and this wear amount is not always constant.

For these reasons, the in-feed amount was not accurately controlled. When the in-feed amount is too large, not only the expensive grinding wheel is rapidly consumed, but also the metal removing ability of the grinding wheel is deteriorated, which may result in leaving a burn mark on the workpiece ground by such grinding wheel. On the other hand, when the in-feed amount is too small, the surface roughness of the grinding wheel is made worse, which affects the grinding accuracy and results in shortening of the truing interval.

The thermal expansion of the grinding wheel causes a change in the diameter of the grinding wheel which also affects the size of the ground workpiece, compensation therefor being very difficult.

SUMMARY OF THE INVENTION

It is therefore an object of the present invention to provide a new and improved grinding machine, wherein the truing apparatus is capable of accurately rendering a constant in-feed to the grinding wheel regardless of the thermal expansion of the grinding wheel, whereby the metal removing surface of the grinding wheel is maintained constant to increase the grinding accuracy and to extend the life of the grinding wheel.

Another object of the present invention is to provide a new and improved grinding machine comprising means for detecting the contact between the detection member and the grinding wheel and means for controlling the in-feed of the truing wheel against the grinding wheel by using the detection of the contact as a reference.

Another object of the present invention is to provide a new and improved grinding machine comprising means for moving the wheel support carrying the grinding wheel by the same amount in the same direction as the movement of the truing head carrying the truing wheel, whereby the change in the size of the workpiece caused by the thermal expansion of the grinding wheel can be compensated for.

Briefly, according to the present invention, these and other objects are achieved by providing a grinding machine, as mentioned below. Work support means is mounted on a bed for rotatably supporting a workpiece to be ground. A wheel support is slidably mounted on the bed for rotatably carrying a grinding wheel made of cubic boron nitride. A traverse carriage is slidable in a direction parallel to the axis of the grinding wheel. Traverse feed means is provided for moving the traverse carriage. A truing head is slidably mounted on the traverse carriage so as to be moved toward and away from the grinding surface of the grinding wheel. A truing wheel is rotatably carried on the truing head. A detection member is mounted on the truing head to be movable toward the grinding wheel. Means is provided for detecting the contact between the detection member and the grinding wheel. Feed means is provided for feeding the truing head toward the grinding wheel until the contact detecting means detects the contact between the detection member and the grinding wheel. The feed means is operable to feed the truing head toward the grinding wheel by a first predetermined distance for truing the grinding wheel in response to the detection of the contact between the detection member and the grinding wheel by the contact detecting means.

In the grinding machine as set forth above, the traverse feed means is operable to move the traverse carriage in one direction to perform a truing operation on the grinding wheel by the truing wheel after the truing head is fed toward the grinding wheel by the first predetermined distance.

The grinding machine, as set forth above, further comprises means for moving the detection member a second predetermined distance after the grinding wheel is trued by the truing wheel, and the traverse feed means is operable to move the traverse carriage in the other direction to cause the detection member to be ground by the grinding wheel so as to be aligned with the truing wheel relative to the periphery of the grinding wheel after the detection member is moved the second predetermined distance.

In the grinding machine as set forth above, the feed means is further operable to retract the truing head a third predetermined distance after the detection member is ground by the grinding wheel.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
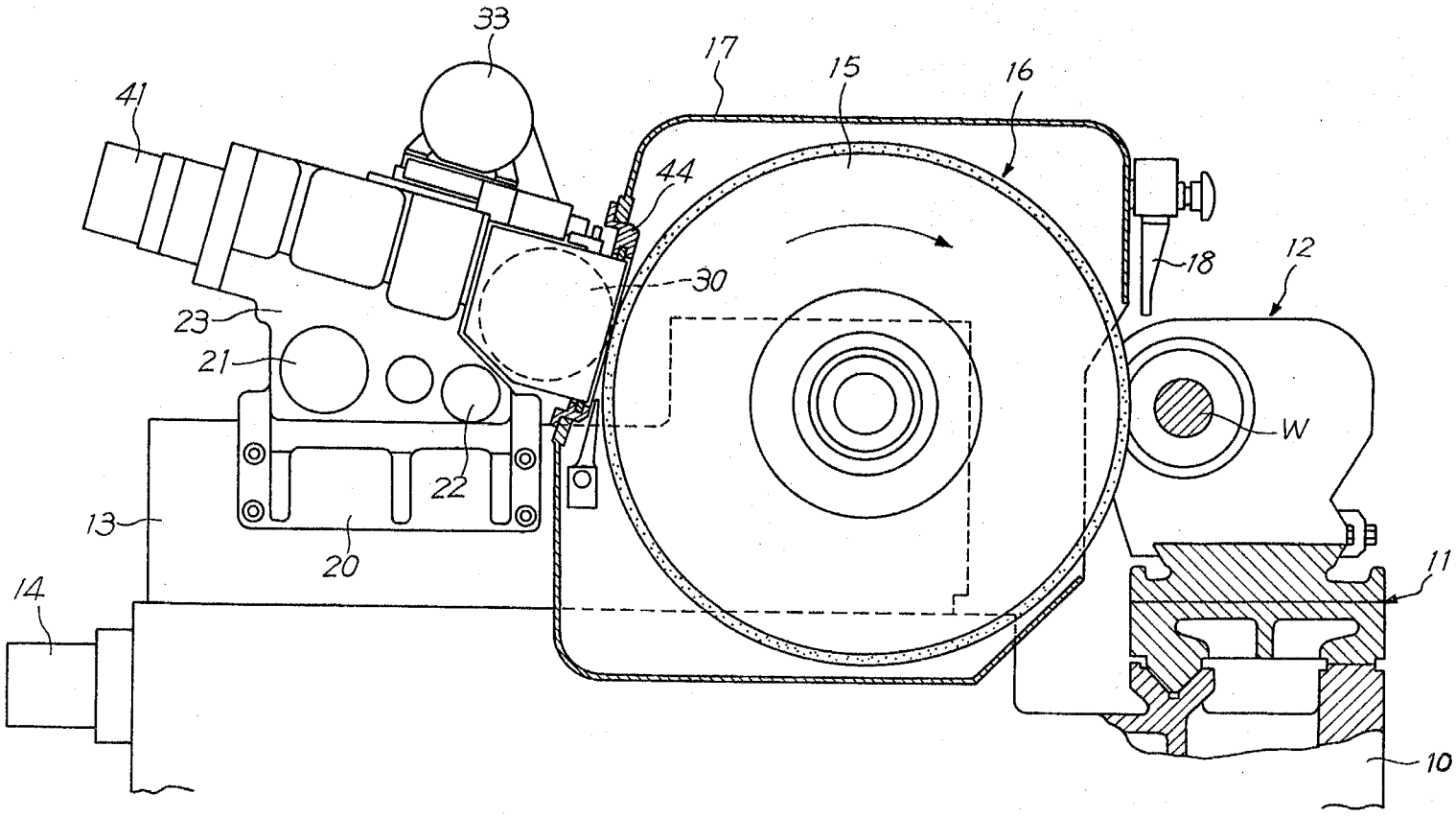
FIG. 1 is a side elevational view, partly in section, of a grinding machine with a truing apparatus according to the present invention.

Referring now to the drawings, wherein like reference numerals or characters refer to identical or corresponding parts throughout the several views, and more particularly to FIG. 1, there is shown a bed 10 of a grinding machine, on which a table 11 is slidably mounted. A workpiece support device 12 is mounted on the table 11 for rotatably supporting a workpiece W to be ground. A wheel support 13 is also mounted on the bed 10 to be movable toward and away from the workpiece W. Feed movement of the wheel support 13 is controlled by a servomotor 14 secured to the bed 10 through a well known thread mechanism. A grinding wheel 16 is mounted on the wheel support 13 to be rotatable about an axis perpendicular to the movement of the wheel support 13. The grinding wheel 16 is of such configuration that abrasive grain, made of a hard material, such as cubic boron nitride, is press-formed and stiffened on the outer peripheral surface of a base ring 15 made of aluminum. This grinding wheel 16 is rotated in the direction of the arrow by a wheel drive motor, not shown, mounted on the wheel support 13. A wheel cover 17 is secured to the side face of the wheel support 13 for covering the grinding wheel 16. A coolant nozzle 18 is secured to the front portion of the wheel cover 17 for supplying coolant fluid during a grinding operation on the workpiece W.

Figure 2:
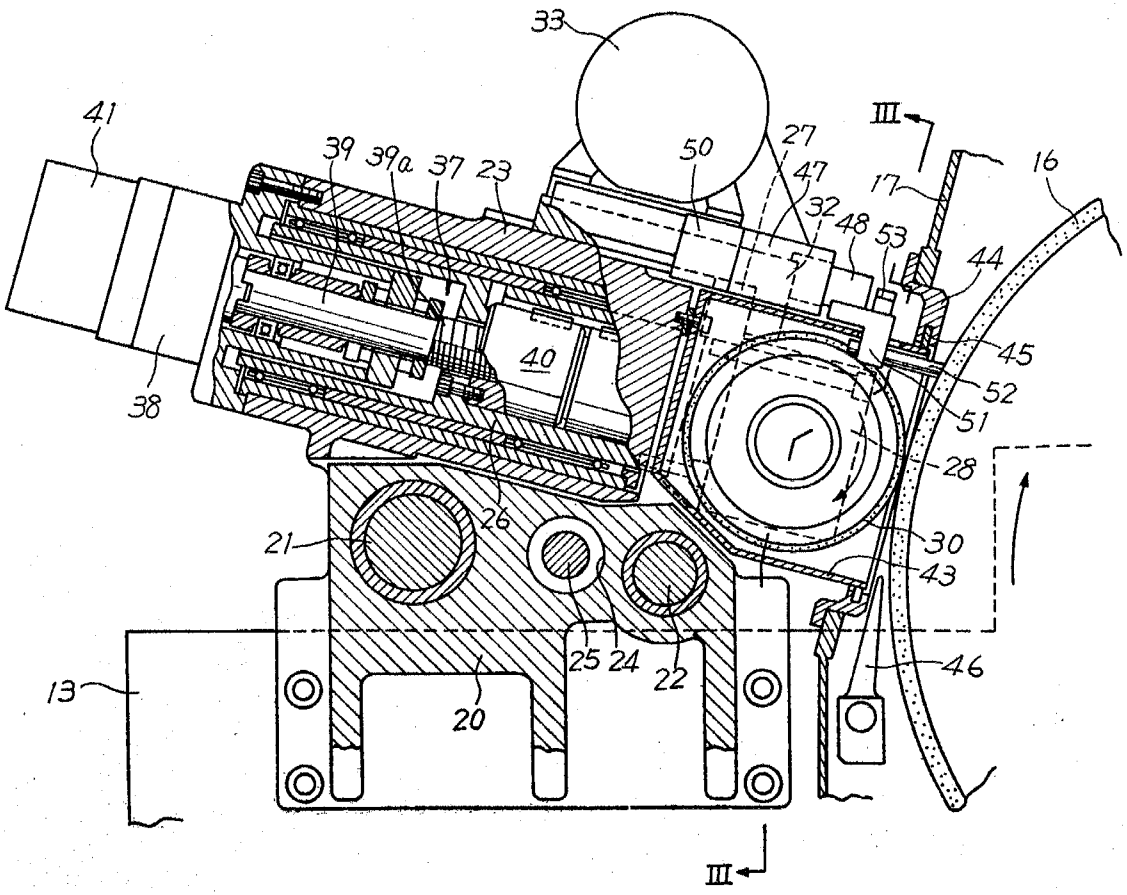
FIG. 2 is a fragmentary enlarged sectional view of the truing apparatus shown in FIG. 1.
Figure 3:
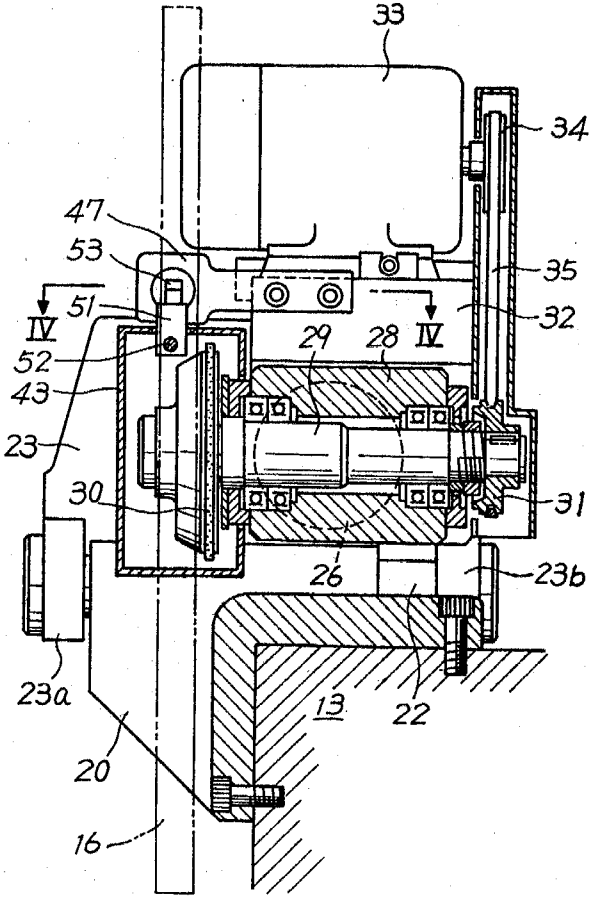
FIG. 3 is a sectional view taken along lines III—III in FIG. 2.

Referring to FIGS. 2 and 3, a support base 20 is mounted on the wheel support 13 rearwardly of the grinding wheel 16. A pair of parallel pilot bars 21 and 22 are received within the support base 20 to be slidable in a horizontal direction parallel to the grinding surface of the grinding wheel 16. End legs **23*a* and 23*b* of a traverse carriage 23 are securedly supported on opposite ends of the pilot bars 21 and 22 projected from the support base 20. The support base 20 is formed with a traverse cylinder 24 within which a piston, not shown, is received to be slidable in a direction parallel to the axes of the pilot bars 21 and 22. A piston rod 25 of the piston is secured to the leg 23*a* of the traverse carriage 23, so that the traverse carriage 23 is traversed a predetermined stroke by the actuation of the traverse cylinder 24**.

An in-feed ram 26 is received in the traverse carriage 23 to be slidable in a direction inclined downwardly toward the center of the grinding wheel 16. The ram 26 has fixed at its one end a plate 27 to which is connected a pilot bar, not shown, slidably received in the traverse carriage 23 for movement in a direction parallel to the axis of the ram 26 to prevent rotation of the ram 26. A truing head 28 is secured to the plate 27 and rotatably carries a support shaft 29 for rotation about an axis parallel to the grinding surface of the grinding wheel 16. A truing wheel 30 is secured to one end of the support shaft 29 and enters within the wheel cover 17 through the opening formed at the rear portion of the wheel cover 17. The truing wheel 30 is such that an abrasive grain of diamond is stiffened on the outer periphery of a metal-made base ring and is designed to have its width less than that of the grinding wheel 16 in order to decrease resistance occurring in the truing operation. The support shaft 29 has secured to its other end a pulley 31 which is connected through belts 35 to a pulley 34 secured to an output shaft of a drive motor 33. The motor 33 is mounted on a slide base 32 which is slidably and adjustably mounted on the traverse carriage 23 for movement in a direction parallel to the axis of the in-feed ram 26. The slide base 32 is also connected to the plate 27 for adjustment of its position. The truing wheel 30 is rotated by the motor 33 in the same direction as is the grinding wheel 16 to perform an up-cut truing operation on the grinding wheel 16.

An in-feed apparatus 37 is provided for in-feeding the truing head 28 secured to the in-feed ram 26 toward the grinding wheel 16. The in-feed apparatus 37 comprises an in-feed box 38 which is secured to the rear end of the traverse carriage 23 and supports an in-feed shaft 39 to be rotatable about the axis coaxial with that of the in-feed ram 26. The in-feed shaft 39 is formed at its front end with a threaded portion **39*a* which is in threaded engagement with a nut 40 secured within the in-feed ram 26. The rear end of the in-feed shaft 39 is connected to a servo-motor 41 through a suitable reduction gearing received in the in-feed box 38**.

A cover 43, formed in rectangular shape in cross-section, is secured to the front end of the traverse carriage 23 to cover the truing wheel 30. A guide frame 44 is fitted into the rear opening of the wheel cover 17 and slidably receives a slide cover 45 for movement in the traversing direction of the traverse carriage 23. The slide cover 45 is formed with a rectangular opening to receive the cover 43. Numeral 46 denotes a coolant nozzle to supply coolant between the truing wheel 30 and the grinding wheel 16.

Figure 4:
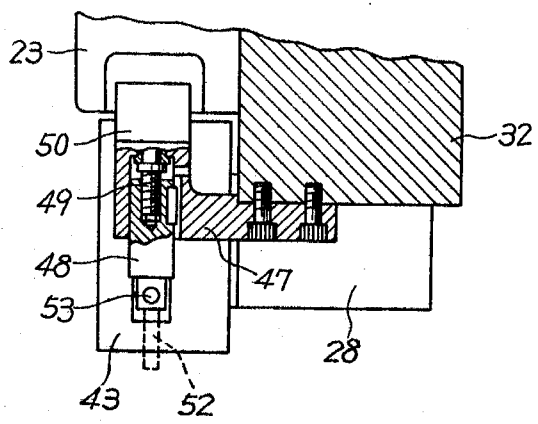
FIG. 4 is a sectional view taken along the lines IV—IV in FIG. 3.

As shown in FIG. 4, a support bracket 47 is secured to the front end of the slide base 32. An in-feed shaft 48 is received in the support bracket 47 to be slidable in the direction parallel to the sliding direction of the in-feed ram 26, but is restrained from rotation relative to the support bracket 47. A feed screw shaft 49, which is in threaded engagement with the in-feed shaft 48, is rotatably supported by the support bracket 47 and is connected to a hydraulic feed device 50, containing a ratchet mechanism therein, to be rotated a predetermined amount. A block 51 in L-shaped configuration is connected at its one end to the front end of the in-feed shaft 48. The other end of the block 51 enters within the cover 43 through the opening formed on the cover 43. A detection bar 52 is detachably secured to the other end of the block 51 in parallel relationship with the in-feed shaft 48. The front end of the detection bar 52 opposes the outer peripheral surface of the grinding wheel 16. A vibration detector 53 is mounted on the block 51 outside the cover 43 for detecting vibration caused by the contact between the detection bar 52 and the grinding wheel 16.

The detection bar 52 is usually positioned in alignment with the truing wheel 30 relative to the periphery of the grinding wheel 16. In accordance with the positional relationship between the detection bar 52 and the truing wheel 30, it is possible to regard as a reference position of the truing wheel 30 a position where the detection bar 52 contacts the grinding wheel 16 through the advance movement of the truing head 28 by the servo-motor 41. As will be described later, the truing wheel 30 being aligned with the detection bar 52 is usually retracted a predetermined distance from the reference position, taking the thermal expansion of the grinding wheel 16 into consideration.

Figure 5:
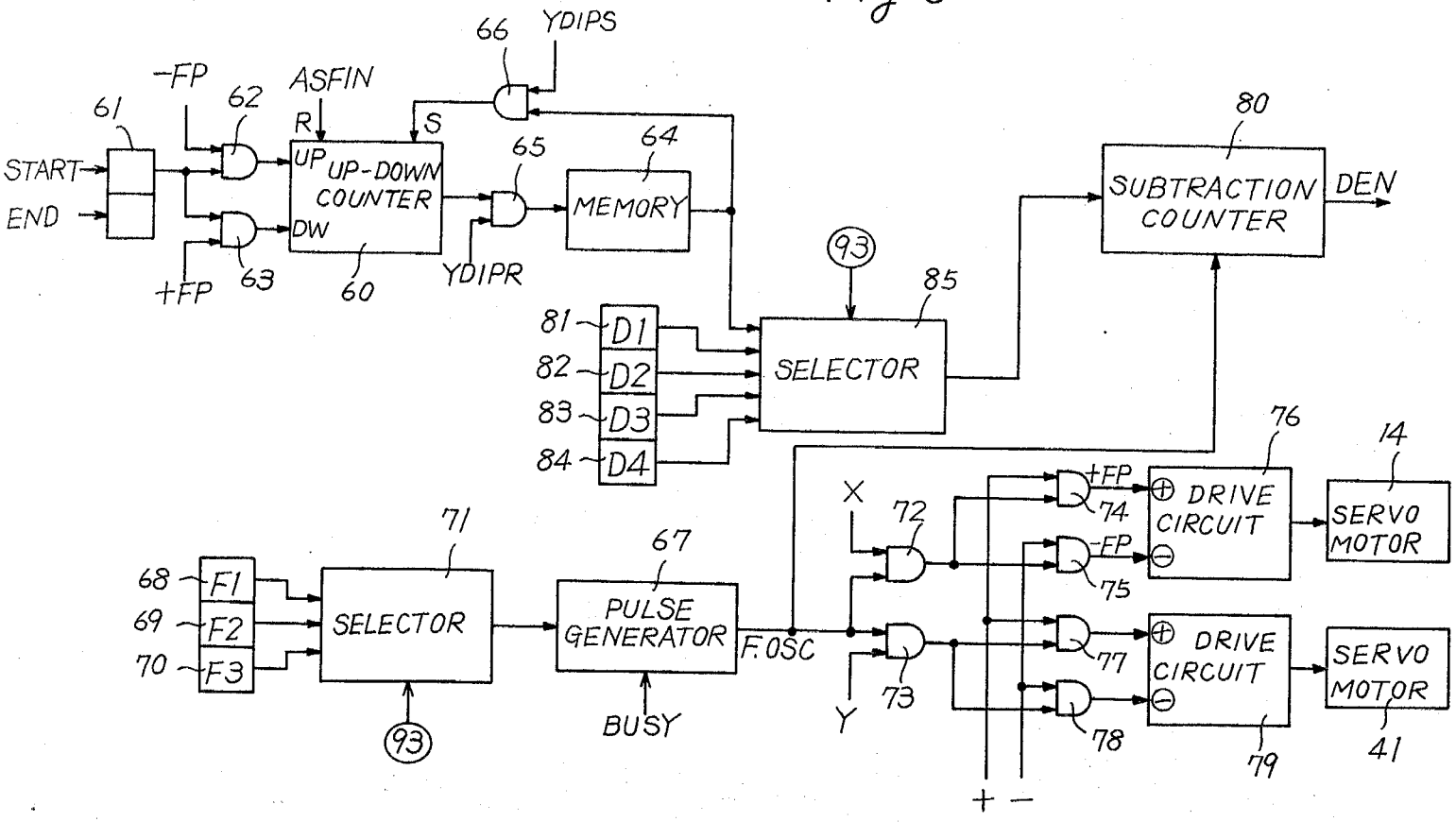
FIG. 5 is a control circuit for controlling the feed movement of a wheel support and a truing head.

A control circuit for controlling the servo-motors 14 and 41 is now described with reference to FIG. 5.

An original position detector, not shown, is provided on the bed 10 for generating a detecting signal ASFIN when the wheel support reaches an absolute original position. The original position detector is fully disclosed in U.S. Pat. No. 4,122,635, the disclosure of which is hereby incorporated by reference. An up-down counter 60 is provided for counting a distance between the absolute original position and a start position which is defined as a position from which the wheel support 13 is started toward the workpiece W to grind the same at various feed speeds in normal grinding cycles and as a position to which the wheel support 13 is retracted from a grinding position after a grinding operation on the workpiece W. The count-up input terminal UP of the counter 60 is connected to the output terminal of an AND gate 62, whose input terminals are respectively connected to receive the output of a flip-flop 61 and advance feed pulses −FP, which will be described later. The flip-flop 61 is set upon receiving a start signal START. The count-down input terminal DW of the counter 60 is connected to the output terminal of an AND gate 63, whose input terminals are respectively connected to receive the output of the flip flop 61 and retraction feed pulses +FP, which will be described later.

A memory circuit 64 is provided for memorizing the content of the up-down counter 60, and is composed of latch relays or core memories so that its memory content will not be lost at the time of an interruption of electric supply or an emergency stop. The input terminal of the memory circuit 64 is connected to the output terminal of the counter 60 through a two-input AND gate 65 which has one input terminal connected to receive a signal YD1PR, described later. The output terminal of the memory circuit 64 is connected to the preset terminal S of the counter 60 through a two-input AND gate 66 which has one input terminal connected to receive a signal YD1PS, described later.

A pulse generating circuit 67 is provided to generate feed pulses F.OSC at a frequency corresponding to a selected feed rate data from a selector 71, while receiving a signal BUSY, described later. The selector 71 selects one of feed rate data F1 to F3 preset in digital switches 68 to 70. The feed pulses F.OSC are applied from the pulse generating circuit 67 to one of the input terminals of each of the two-input AND gates 72 and 73 which are also connected to receive a signal X for moving the wheel support 13 and a signal Y for moving the truing head 28, respectively. The output of the AND gate 72 is applied to one of the input terminals of each of the two-input AND gates 74 and 75 which are also connected to receive a signal "+" and a signal "−", respectively, described later. The AND gate 74 distributes the feed pulses F.OSC as retraction feed pulses +FP to a positive input terminal of a drive circuit 76 which is connected to the servo-motor 14. The AND gate 75 distributes the feed pulses F.OSC as advance feed pulses −FP to a negative input terminal of the drive circuit 76. The output of the AND gate 73 is applied to one of the input terminals of each of the two-input AND gates 77 and 78 which are also connected to receive the signals "+" and "−" to distribute feed pulses to positive and negative terminals of a drive circuit 79, respectively, which is connected to the servo-motor 41.

A subtraction counter 80 is connected to a selector 85 to be preset with a data selected thereby. The selector 85 selects one of feed amount data D1 to D4 preset in digital switches 81 to 84 and a stored value in the memory circuit 64. The substraction counter 80 receives the feed pulses F.OSC to subtract the same from the preset value and generates a signal DEN when the content thereof becomes zero.

Figure 6:
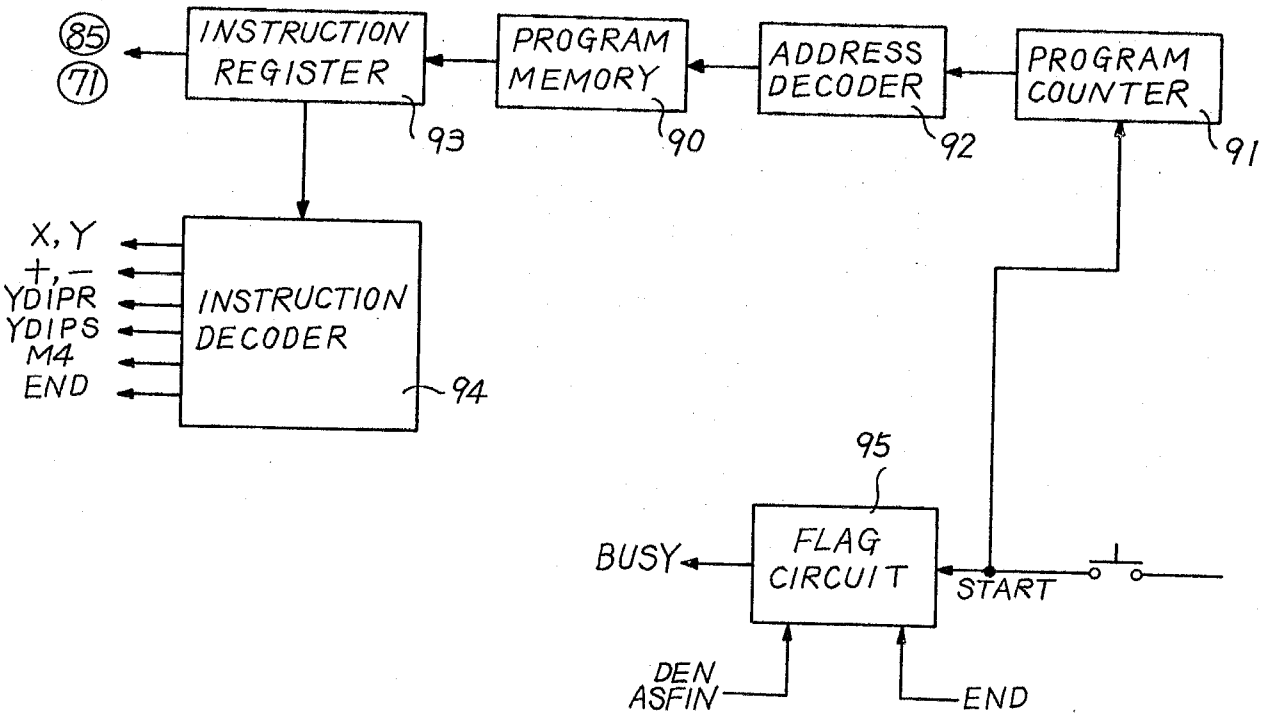
FIG. 6 shows data read-out means and a flag circuit.

Referring to FIG. 6, a program memory 90 contains control programs at its memory addresses. A program counter 91 is provided for designating memory addresses at which the control program or data are stored. An address decoder 92 is connected between the program counter 91 and the memory 90 and decodes the content of the program counter 91 so as to select the memory address of the program memory 90 designated by the program counter 91. An instruction register 93 is connected to the program memory 90 to temporarily store and read out one block of the control data being stored at the selected memory address of the program memory 90. This register 93 generates feed amount data D1 to D4 and feed rate data F1 to F3 of the control area, respectively, to the selectors 85 and 71, and also outputs other data X, Y, +, −, YD1PR, YD1PS, M4 and END to an instruction decoder 94.

A flag circuit 95 is provided to generate the signal BUSY during the execution of a feed operation. The flag circuit 95 discontinues generating the signal BUSY, while a timing pulse generating circuit, now shown, generates timing pulses.

The circuits shown in FIG. 6 are more fully disclosed in U.S. Pat. No. 4,122,635, the disclosure of which is hereby incorporated by reference.

The operation of the above-described construction will be now described.

When the metal removing ability of the grinding wheel 16 is lowered as a result of repeated grinding cycles, a truing start push button switch is depressed with the wheel support 13 being positioned at the start position. With the start push button switch being depressed, programs for a truing cycle, shown in TABLE 1, which are stored at memory addresses m100 to m104, m200 to m204 and m300 to m304 in the program memory 90, are successively read out.

TABLE 1

| START 1 (Feed Cycle) | |
|---|---|
| m100 | Y-D1F3 |
| m101 | YD1PS |
| m102 | X-D1F3 |
| m103 | YD1PR |
| m104 | M4 |
| START 2 (In-Feed Cycle) | |
| m200 | Y-D2F3 |
| m201 | YD1PS |
| m202 | X-D2F3 |
| m203 | YD1PR |
| m204 | END |
| START 3 (Return Cycle) | |
| m300 | Y+D3F3 |
| m301 | YD1PS |
| m302 | X+D3F3 |
| m303 | YD1PR |
| m304 | END |

One block of the control data Y-D1F3 stored at the memory address m100 is first read out. The selector 85 renders effective the digital switch 81, setting the feed amount data D1 therein, so that the set value D1 in the digital switch is preset in the subtraction counter 80. The selector 71 renders effective the digital switch 70, setting the feed rate data F3 therein, so that the set value F3 in the digital switch 70 is loaded into the pulse generating circuit 67. Under these conditions, when the signal BUSY is applied from the flag circuit 95 into the pulse generating circuit 67, the pulse generating circuit 67 generates feed pulses F.0SC at a frequency corresponding to the feed rate data F3. These feed pulses F.OSC are applied through the AND gate 73 receiving the signal Y and the AND gate 78 receiving the signal "−" to the negative terminal of the drive circuit 79 so as to rotate the servo-motor 41 in the reverse direction. Accordingly, the in-feed shaft 39 is rotated in the reverse direction to in-feed the in-feed ram 26 and the truing head 28 toward the grinding wheel 16 through the thread mechanism. Feed pulses F.OSC generated from the pulse generating circuit 67 are also applied to the subtraction counter 80 to subtract the content thereof. When the content of the subtraction counter 80 becomes zero, the subtraction counter 80 generates the signal DEN which is applied to the flag circuit 95. Upon receiving the signal DEN, the flag circuit 95 stops generating the signal BUSY so as to cause the pulse generating circuit 67 to discontinue generating the feed pulses F.OSC.

Accordingly, the servo-motor 41 is rotated in the reverse direction by the amount preset in the subtraction counter 80, so that the truing head 28 is in-fed a predetermined amount (several microns). The truing wheel 30 and the detection bar 52 being in alignment with each other relative to the periphery of the grinding wheel 16 are moved together toward the grinding wheel 16. However, a predetermined distance D is kept between the grinding wheel 16 and the detection bar 52 in the previous truing cycle, taking the thermal expansion of the grinding wheel 16 into consideration. This distance D may be reduced to D' (FIG. 7(*a*)) in the succeeding grinding cycles depending upon the extent of the thermal expansion of the grinding wheel 16. If the distance D' is relatively large, the detection bar 52 does not contact the grinding wheel 16, even if the truing head 28 is in-fed the predetermined distance. Accordingly, the vibration detector 53 generates no signal.

When the next one block of the control data YD1PS stored at the memory address m101 is read out, the decoder 94 generates the signal YD1PS which is applied to the AND gate 66, whereby the stored value stored in the memory circuit 64 is set in the up-down counter 60.

When one block of the control data X-D1F3 stored at the memory address m102 is subsequently read out, the feed amount data D1 set in the digital switch 81 is selected by the selector 85 and preset in the subtraction counter 80. The pulse generating circuit 67 generates the feed pulses F.OSC at a frequency corresponding to the feed rate data F3. These feed pulses F.OSC are applied through the AND gate 72 receiving the signal X and the AND gate 75 receiving the signal "−" to the negative terminal of the drive circuit 76 so as to rotate the servo-motor 14 in the reverse direction. Accordingly, the wheel support 13 is advanced by the amount preset in the subtraction counter 80, that is, the in-feed amount of the truing head 28. The advance feed pulses −FP output from the AND gate 75 are also applied through the AND gate 62 to the count-up input terminal UP of the up-down counter 60, so that the content of the counter 60 is changed as the wheel support 13 is advanced.

When one block of the control data YD1PR stored at the memory address m103 is then read out, the decoder 94 generates the signal YD1PR which is applied to the AND gate 65, whereby the content of the up-down counter 60 is stored in the memory circuit 64. The one block of the control data M4 stored at the memory address m104 is then read out, which commands the repeated infeed of the truing head 28 if the vibration detector 53 generates no signal.

Based upon such repeated in-feed command, the truing head 28 is further in-fed by the predetermined amount, and the wheel support 13 is advanced by the same amount in the same direction as the movement of the truing head 28. When the vibration detector 53 is not operated at the time the signal M4 is generated, the repeated in-feed command is again instructed.

Figure 7:
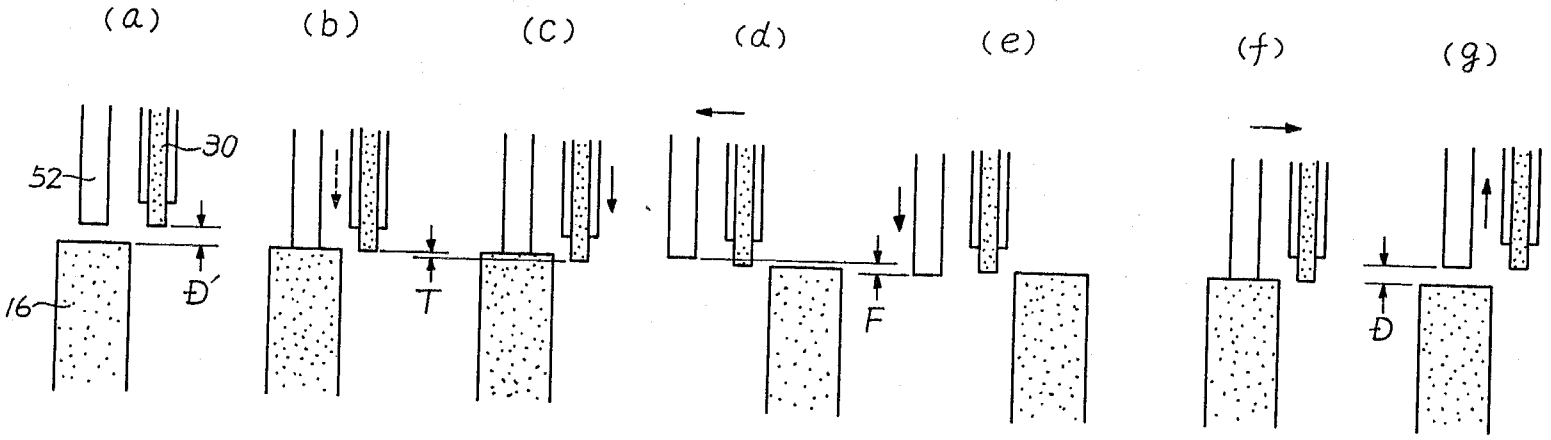
FIG. 7 shows a positional relationship between a grinding wheel and a truing wheel in a truing cycle.

When the detection bar 52 contacts the grinding wheel 16, as shown in FIG. 7(*b*), after the repetition of the above-mentioned steps, the vibration detector 53 generates the detection signal. Accordingly, the generation of the signal M4 and the detection signal from the vibration detector 53 instructs the next truing in-feed cycle.

Based upon the instruction of the truing in-feed cycle, one block of the control data Y-D2F3 stored at the memory address m200 is read out. Accordingly, the selector 85 renders the digital switch 82, setting the feed amount data D2 therein effective so that the set value D2 in the digital switch 82 is preset in the subtraction counter 80. The selector 71 renders the the digital switch 70, setting the feed rate data F3 therein, effective so that the set value F3 in the digital switch 70 is loaded into the pulse generating circuit 67. When the signal BUSY is applied into the pulse generating circuit 67, the same generates feed pulses F.OSC at a frequency corresponding to the feed rate data F3. These feed pulses F.OSC are applied through the AND gates 73 and 78 to the negative terminal of the drive circuit 79 so that the servo-motor 41 is rotated in the reverse direction by the amount D2 preset in the subtraction counter 80. Accordingly, the truing head 28 is advanced a predetermined amount T suitable in a truing operation, as shown in FIG. 7(*c*). By the advance movement of the truing head 28, the detection bar 52 is ground by the grinding wheel 16 and located at a position retracted by the in-feed amount T relative to the truing wheel 30.

Subsequently, control data YD1PS, X-D2F3, and YD1PR stored at the memory addresses m201 to m203, respectively, are read out one block by one block. Accordingly, the memorized value stored in the memory circuit 64 is set in the up-down counter 60 and the wheel support 13 is advanced by the servo-motor 14 by the in-feed amount T (feed amount D2 set in the digital switch 82) of the truing head 28. Thereafter, the content of the up-down counter 60 is stored in the memory circuit 63. When one block of control data END stored at the memory address m204 is read out, the decoder 94 generates the signal END. Based upon this signal END, the drive motor 33 is energized to rotate the truing wheel 30 in the same direction as the grinding wheel 16 and the coolant nozzle 46 supplies coolant.

The traverse cylinder 24 is then supplied with pressurized fluid to traverse the piston rod 25 and the traverse carriage 23 supported by the pilot bars 21 and 22 through a predetermined distance. Accordingly, the grinding wheel 16 is trued by the truing wheel 30, as shown in FIG. 7(*d*). When the traverse carriage 23 reaches its traverse end, the hydraulic feed device 50 is operated to rotate the feed screw shaft 49 a predetermined angular amount, so that the in-feed shaft 48 and the detection bar 52 is advanced a predetermined amount F (truing in-feed amount T $+\alpha$), as shown in FIG. 7(*e*). Thereafter, the supply of pressurized fluid into the traverse cylinder 24 is changed over to traverse the traverse carriage 23 in the opposite direction. Accordingly, the detection bar 52 is ground by the grinding wheel 16 trued by the truing wheel 30, whereby the truing wheel 30 and the end of the detection bar 52 are aligned with each other relative to the periphery of the grinding wheel 16, as shown in FIG. 7(*f*). When the traverse carriage 23 reaches back to its original position, the drive motor 33 is deenergized and the supply of coolant from the coolant nozzle 46 is stopped.

In this manner, when the truing operation on the grinding wheel 16 is completed, a truing return cycle is instructed. Based upon this instruction of the truing return cycle, one block of the control data Y+D3F3 stored at the memory address m300 is read out. Accordingly, the selector 85 renders the ditigal switch 83, setting the feed amount data D3 therein, effective and the set value D3 in the digital switch 83 is preset in the subtraction counter 80. The pulse generating circuit 67 generates feed pulses F.OSC at a frequency of the feed rate data F3 in response to the signal BUSY. These feed pulses F.OSC are applied through the AND gates 73 and 77 to the positive terminal of the drive circuit 79 to rotate the servo-motor 41 in the positive direction by the amount preset in the subtraction counter 80. Accordingly, the truing head 28 is retracted a predetermined amount D (several ten microns) away from the grinding wheel 16, whereby the clearance D is formed between the grinding wheel 16 and the detection bar 52, as shown in FIG. 7(*g*). This clearance D is set to be large enough to prevent the contact between the grinding wheel 16 and the detection bar 52, even if the grinding wheel 16 is thermally expanded.

Subsequently, control data YD1PS, X+D3F3 and YD1PR stored at the memory addresses m301 to m303, respectively, are read out one block by one block. Accordingly, the stored value stored in the memory circuit 64 is set in the up-down counter 60 and the retraction feed pulses +FP are distributed into the servo-motor 14 by the feed amount D3 set in the digital switch 83 to retract the wheel support 13 by the same amount as the retraction of the truing head 28. Thereafter, the content of the up-down counter 60 is stored in the memory circuit 64. When one block of control data END stored at the memory address m304 is read out, the decoder 94 generates the signal END to complete the whole of the truing cycle.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A grinding machine comprising:

a bed;

work support means mounted on said bed for rotatably supporting a workpiece to be ground;

a wheel support slidably mounted on said bed for rotatably carrying a grinding wheel made of cubic boron nitride;

a traverse carriage slidable in a direction parallel to the axis of said grinding wheel;

traverse feed means for moving said traverse carriage;

a truing head slidably mounted on said traverse carriage so as to be moved toward and away from the grinding surface of said grinding wheel;

a truing wheel rotatably carried on said truing head;

a detection member mounted on said truing head in spaced relationship with said truing wheel in an axial direction of said truing wheel and movable toward said grinding wheel;

means for detecting the contact between said detection member and said grinding wheel;

feed means for feeding said truing head toward said grinding wheel until said contact detecting means detects the contact between said detection member and said grinding wheel;

said feed means being operable to feed said truing head toward and past said grinding wheel by a first predetermined distance for truing said grinding wheel in response to the detection of the contact between said detection member and said grinding wheel by said contact detecting means, said detection member being ground by said grinding wheel to a depth equal to the first predetermined distance;

said traverse feed means being operable to move said traverse carriage in one direction to perform a truing operation on said grinding wheel by said truing wheel after said truing head is fed toward said grinding wheel by the first predetermined distance;

means for moving said detection member a second predetermined distance toward said grinding wheel after said grinding wheel is trued by said truing wheel;

said traverse feed means being operable to move said traverse carriage in the other direction to cause said detection member to be ground by said trued grinding wheel so as to be aligned with said truing wheel relative to the periphery of said grinding wheel after said detection member is moved the second predetermined distance; and said feed means being operable to retract said truing head a third predetermined distance after said detection member is ground by said trued grinding wheel.

2. A grinding machine as claimed in claim 1, wherein:

said traverse carriage is mounted on said wheel support.

3. A grinding machine as claimed in claim 2, wherein:

said contact detecting means includes a vibration detector for detecting vibration caused by the contact between said detection member and said grinding wheel.

4. A grinding machine as claimed in claim 3, including:

second feed means for moving said wheel support by the same amount in the same direction as the movement of said truing head.

5. A grinding machine as claimed in claim 4, wherein:

said feed means and said second feed means include servo-motors for controlling the movements of said truing head and said wheel support.

6. A grinding machine as claimed in claim 1, wherein:

said feed means is operable to feed said truing head toward said grinding wheel a unit amount by a unit amount until said contact detecting means detects the contact between said detection member and said grinding wheel.

* * * * *